US008864398B2

(12) United States Patent
McNamara et al.

(10) Patent No.: US 8,864,398 B2
(45) Date of Patent: Oct. 21, 2014

(54) PRESS-ON COSMETIC APPLICATOR SYSTEM

(75) Inventors: William E. McNamara, Chester, NY (US); Gregory A. Ornoski, Teaneck, NJ (US); David Cerutti, Putnam Valley, NY (US)

(73) Assignee: Avon Products Inc., New York, NY (US)

( * ) Notice: Subject to any disclaimer, the term of this patent is extended or adjusted under 35 U.S.C. 154(b) by 465 days.

(21) Appl. No.: 13/290,616

(22) Filed: Nov. 7, 2011

(65) Prior Publication Data

US 2013/0114989 A1 May 9, 2013

(51) Int. Cl.
*A45D 33/00* (2006.01)
*A45D 40/26* (2006.01)

(52) U.S. Cl.
CPC ..... *A45D 40/265* (2013.01); *A45D 2200/1018* (2013.01); *A45D 2200/051* (2013.01)
USPC ..... 401/130; 401/126; 401/9; 401/10

(58) Field of Classification Search
USPC ..... 401/9, 10, 134, 118, 126, 130; 132/216–218, 224, 317
See application file for complete search history.

(56) References Cited

U.S. PATENT DOCUMENTS

| | | | | |
|---|---|---|---|---|
| 2,998,821 | A * | 9/1961 | Hurdel | 132/218 |
| 4,403,624 | A | 9/1983 | Montgomery | |
| 4,458,701 | A * | 7/1984 | Holland | 132/218 |
| 5,061,103 | A | 10/1991 | Walsh-Smith | |
| 5,074,693 | A | 12/1991 | Iisuka et al. | |
| 5,172,992 | A | 12/1992 | Ackermann | |
| 5,700,100 | A | 12/1997 | Ackermann | |
| 6,167,890 | B1 | 1/2001 | Gueret | |
| 6,325,071 | B1 * | 12/2001 | Butcher | 132/218 |
| 6,716,419 | B2 | 4/2004 | Zoltowski et al. | |
| 6,789,551 | B2 | 9/2004 | Iosilevich | |
| 7,223,035 | B1 | 5/2007 | Engel et al. | |
| 2007/0110509 | A1 | 5/2007 | Dumler | |

* cited by examiner

*Primary Examiner* — David Walczak
(74) *Attorney, Agent, or Firm* — David M. Joyal; Joan M. McGillycuddy

(57) ABSTRACT

Packaging for cosmetic products, such as mascara, are provided, including a container for holding a cosmetic composition and an applicator which is disposed within a cut-out portion of the container. The container includes a number of passages through at least one side such that a portion of the applicator is brought into contact with the passages when seated on the container. The applicator is adapted to seal the container when seated on the container. The applicator is further adapted to be removed from the container and pressed or squeezed onto keratinous fibers (e.g., eyelashes) of a user to apply the cosmetic product.

23 Claims, 2 Drawing Sheets

PRESS-ON COSMETIC APPLICATOR SYSTEM

FIELD OF THE INVENTION

The present application generally relates to packaging for cosmetic products, such as mascara, which comprises a container for holding a cosmetic composition and an applicator which is disposed within a cut-out portion of the container. The container comprises a number of pores through at least one side such that a portion of the applicator is brought into contact with the pores when seated within a cut-out portion of the container. The applicator is adapted to seal the container when seated within the cut-out portion. The applicator is further adapted to be removed from the container and pressed or squeezed onto keratinous fibers (e.g., eyelashes) of a user to apply the cosmetic product.

BACKGROUND

Conventional mascara packaging consists of a cylindrical container that contains a supply of mascara, the container having a threaded neck to which a cap and rod applicator assembly is reversibly secured by complementary threading on the cap. The rod is inserted into the container through a wiper prior to closing the cap and, as the user screws the cap onto the container, the rod only moves a short distance (i.e., the height of the threaded area) further into the container. When the user unscrews the cap and withdraws the rod, the wiper scrapes or removes excess cosmetic from the applicator element to provide a more uniform, metered dose of mascara on the applicator. The wiper conventionally consists of an annular construction of rubber or plastic in or near the neck of the container. Such mascara applicators and packaging are disclosed, for example, in U.S. Pat. No. 4,403,624 to Montgomery and U.S. Pat. No. 5,061,103 to Walsh-Smith, to name just a few.

The mascara applicator is typically a twisted wire brush or molded plastic brush that may or may not have a curve in longitudinal direction, the curve being consistent with the curve of the eyelash. Mascara contained on the brush is applied by the consumer typically in a series of upward brush strokes. The multiple brush stokes are necessary because the length of the eyelash is typically longer than the brush, and also because the amount of mascara needed to be applied to the eyelash is often more than the brush can hold. Even when the brush is capable of holding sufficient composition, it is then difficult to control or apply uniformly to the eyelash. Additionally, the user may vary the number of upward brush strokes to obtain a desired lash look. Furthermore, these known wire bristle brushes only apply composition to one surface (i.e., either the top or bottom surface) of the eyelash with each stroke.

Another drawback with the mascara brush associated with the conventional mascara product is that clumping of the viscose cosmetic on the eyelash occurs following the initial application of the cosmetic, i.e., when depositing a second, third, or more applications in an attempt to obtain complete coverage of the eyelash by the mascara product. This is because the typically pseudoplastic or thixotropic cosmetic composition of the initial (or predecessor) application has begun to dry or has an increasing yield stress making the subsequent application(s) difficult.

A further difficulty is that the wire brush applicators, while useful for eyelashes, are unsuitable for facial hair, scalp hair, and eyebrows. Other cosmetic applications are difficult with such wire brush applicators.

There is a continuing need in the art for improved functional designs for cosmetic containers and applicators, which overcome one or more of the deficiencies of the conventional cosmetic packages identified above. In particular it is therefore an object of the invention to provide cosmetic packages that allow for the deposition of cosmetic composition to a substrate, in particular keratin (or keratinous) fibers, and especially eyelashes, with a single application stroke, i.e., substantially avoiding or eliminating the need to apply additional composition to the substrate (or to an area of the substrate) that has already received a first deposition of composition.

SUMMARY OF THE INVENTION

In accordance with the foregoing objectives and others, the present invention provides packages for cosmetics having an applicator which engages with a container in a manner such that the applicator may access a cosmetic contained therein through one or more passages in the side(s) of the container, e.g., pores, apertures, or slots as further described herein.

The invention provides a new package including a container having a chamber in the interior thereof for holding a charge of a composition (e.g., a mascara, eye shadow, or other cosmetic), and two generally opposed faces, at least one of which typically has a plurality of passages configured to provide fluid communication from the interior chamber to the exterior of the container. The passages are configured to allow egress of the composition from within the container and onto the applicator positioned adjacent the passages.

The package also includes an applicator in the form of two elongated, planar, typically generally flat, levers adjoined on a fulcrum at one end thereof. The applicator is configured to be seated on the container such that the levers cover the exposed portions of the plurality of apertures to prevent escape of the composition from the container when the applicator is seated on the container. The applicator typically has a textured surface on the container-facing side of at least one of the levers. This textured surface may be used to hold a charge of the composition, and the applicator is capable of transferring the same to a substrate by squeezing the applicator such that the terminal ends of the levers contact the substrate.

By virtue of the particular applicator arrangement, the applicator is capable of transferring the charge of composition to the surface of the substrate in a single application, the size of the substrate to which product is so transferred being limited only by the width of the applicator. The ability to transfer composition charge in a single application is particularly advantageous where the composition is pseudoplastic, having a high initial viscosity in the absence of shear.

These and other aspects of the invention will be better understood by reading the following detailed description and appended claims.

BRIEF DESCRIPTION OF THE DRAWINGS

The preferred embodiments of the present invention are illustrated by way of example and are not limited to the following figures.

DETAILED DESCRIPTION

All terms used herein are intended to have their ordinary meaning in the art unless otherwise provided.

The materials to be dispensed are not particularly limited and include paints, cosmetics, and adhesives, to name a few, and may be in the form of solids (e.g., powders), suspensions, emulsions, liquids, and the like. As used herein, the term "liquid" is intended to include very viscous materials, including non-Newtonian liquids having high initial viscosities, as well as gels and other materials capable of being dispensed from a container onto an applicator. Particular mention may be made of cosmetics, including, without limitation, mascara, foundation, lip gloss, lip colors, hair colors, hair styling formulations, nail polishes, and the like. The viscosity of the composition is not limited and may range, for example, from about 10 cps to about 1,000,000 cps. Without intending to be limited, it is believed that the advantages of the present invention will be most fully realized when the cosmetic formulations are pseudoplastic or thixotropic, or otherwise have high viscosities at room temperature (e.g., greater than about 10,000 cps) such that they tend to set up on the substrate quickly in the absence of shear forces making subsequent applications difficult and leading to unsightly clumping of the composition being applied. In one preferred embodiment, the product is in the form of a mascara for application to the eyelashes.

Figure 1:
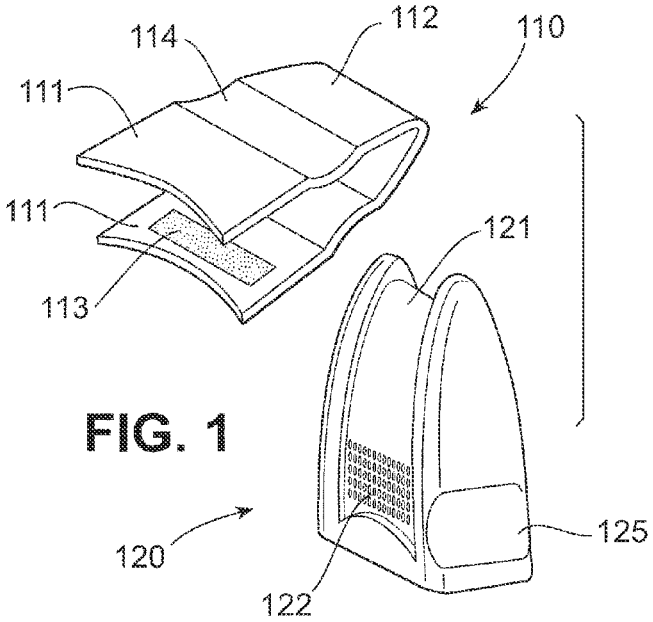
FIG. 1 illustrates an exemplary package for dispensing a material according to one embodiment, wherein an applicator 110 is removed from a container 120.

Referring to FIG. 1, an exemplary package according to the invention is illustrated. A container 120 is shown comprising side walls extending from a closed base to a closed top to define an interior space or chamber for holding a charge of liquid or solid (e.g., powder). The container 120 may be directly filled with the liquid or solid product or may contain various structures, such as a non-woven material or a sponge, which are pre-soaked or impregnated with the product. As shown, the container 120 is compact and loosely prismatic in shape. The container 120 may be made of any suitable material, for example, molded or blow-molded plastic, glass, metal, laminated material, or any combination thereof. Moreover, although the container 120 will typically be flexible in one or more dimensions, it may also be a solid structure.

As shown, the container 120 has a cut-out section 121 extending from a first side to a second side of the container via the top of the container. The dimensions and size of the cut-out section 121 will vary depending on the geometry of the applicator 110 and container 120, but will typically be formed to allow at least a portion of the applicator to be nested or seated within the cut-out section. Accordingly, the cut-out section 121 will typically correspond in shape to the applicator 110, but will be slightly wider than the applicator. Moreover, the depth of the cut-out section 121 may be about equal to the thickness of the arms 111 of the applicator 110, such that the applicator may be nested within the cut-out section without slipping. This allows for the package to be substantially uniform in shape.

In one embodiment, the container 120 may simply have one or more protrusions on the outside surface thereof, rather than (or in addition to) a portion of a certain depth removed from the outside surface. Therefore, the applicator 110 may sit on the outside surface of the container 120, while being prevented from slipping off of the container by the protrusions.

The container 120 is also shown to comprise one or more passages shown as apertures 122 in FIG. 1 extending from at least one side wall of the container to the inside thereof. The apertures 122 are designed such that the material contained within the container 120 may exit through the apertures, such as when the container is squeezed by a user or via capillary action. It will be appreciated that the apertures 122 may be adapted to substantially prevent the material within the container 120 from exiting the container, unless a force is applied. For example, when the material is a liquid, such as a mascara, the material will be substantially prevented from escaping due to the size of the apertures 122, the thixotropic properties of the liquid, and/or the surface tension of the liquid.

The container 120 may comprise any number of passages of varying shapes and sizes. For example, the container 120 may comprise a single passage of any shape (e.g., a triangular, circular, rectangular, or other shape) or multiple passages arranged in a fixed pattern (e.g., line, matrix, rectangle, triangle, circle, etc.) or random pattern. The passages may each comprise the same shape, or may vary in shape. Moreover, the container 120 may comprise passages on a single side thereof or on multiple sides.

As shown in FIG. 1 the passages are a plurality of apertures 122 typically located within the cut-out section 121, such that the applicator 110, when seated in the cut-out section, will cover them. If the container 120 does not comprise a cut-out section 121, the apertures 122 will nonetheless be located such that they may be covered by an applicator 110. When the container is squeezed by a user, the apertures 122 allow for impregnating or coating of an applicator element 113 with a material contained in container 120. Additionally, the applicator element can receive a uniform charge of the composition from the container, or the apertures 122 can be designed to provide a charge gradient along the length or width of the applicator element 113. In one embodiment discussed below in additional detail, the applicator element may have a non-linear geometry. For example the applicator element may have an accurate shape to mimic the shape of an eyelash, or to provide, typically in concert with the nature of the composition, a curling effect to the eyelash.

In one exemplary embodiment, the container 120 may include grooves or depressions 125 within the body to allow for easy grip and manipulation of the container. The container 120 may include one or more grooves 125, but will typically include two grooves shaped to be manipulated by the fingers of a user, for example the thumb and pointer-finger, such that a user may squeeze the container 120 to force a material through the pores 122.

An exemplary applicator 110 is also shown comprising two elongated, generally flat, levers ("arms") 111 adjoined on a fulcrum ("adjoining section") 112 at one end thereof, to form a wish-bone like shape. The applicator 110 may be made of any suitable material, for example, molded or blow-molded plastic, glass, metal, laminated material, or any combination thereof. In one preferred embodiment, the applicator is made from a material having an elasticity that allows for the inward movement of the arms 111, without distortion to the applicator shape. The applicator 110 may be formed from a unitary piece of material or may comprise separate members that are connected.

The applicator is shown to have two arms 111, which are adapted to allow the applicator to be secured to the container 120, such as by clamping on to the cut-out section 121 of the container. While the arms 111 may be pressed together without distortion to the applicator shape, the arms should have a limited range of motion in the outward direction such that a satisfactory inward force may be exerted on the container 120 when the applicator is nested thereon. Accordingly, the dimensions of the applicator 110 will depend on the dimensions of the container 120, as well as the desired use. Typically, at least 50%, preferably 75%, most preferably 95%, of the width of the eyelash array (lash bed) (e.g., from about 0.5 inches to about 1 inch) is contacted from a single deposition from the applicator.

Figure 5:
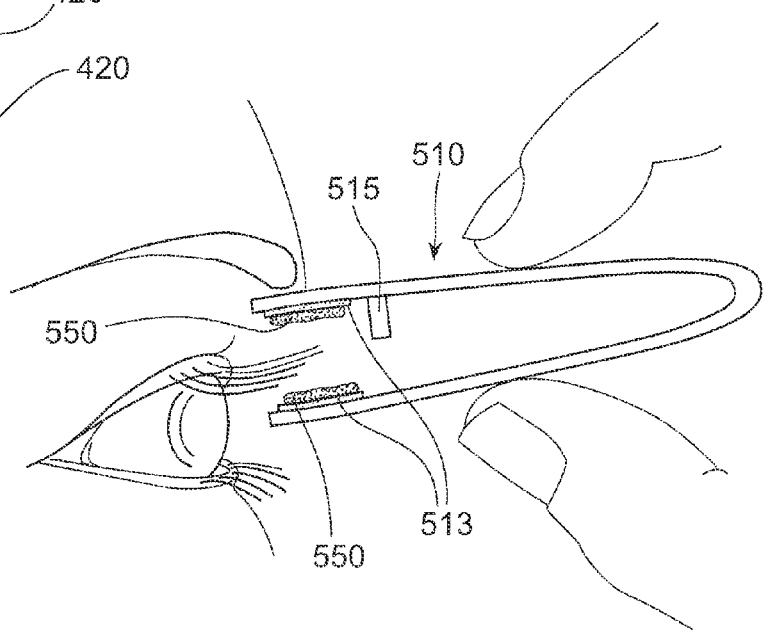
FIG. 5 is a process diagram for the application of a material, according to an exemplary embodiment.

Although not shown, one or both arms 111 may have a mechanical stop incorporated within the interior surface (see, e.g., FIG. 5 at 515). The mechanical stop(s) restricts the movement of the applicator to a preset distance, which may allow the user to touch the surface of, for example, the eyelashes during use, without pinching the surface of the same.

In one embodiment, the arms 111 may be specially adapted with impressions or textured surfaces for gripping with the fingers. For example, the applicator may comprise a depressed area 114 located between the arms 111 and adjoining section 112 for facilitating a user's grip. Due to its shape, the applicator 110 flexes at the user's pressing or squeezing of the outer face of the arms 111, and each of the arms may be brought into contact with the other depending on the force exerted.

As shown, one or both of the arms 111 may have a textured surface (e.g., an "applicator element") 113 disposed on the interior thereof (i.e., the surface facing the container). The applicator element 113 may be made of any material and configuration capable of holding a charge of liquid or solid material and transferring it to the desired surface, such as a human integument, including keratinous fibers (hair of the scalp, eyelashes, etc.), nails, lips, skin, or the like. The applicator element 113 may, for instance, take the form of a foam pad, a molded brush, a twisted wire brush, a flocked surface, a staked fiber brush, a comb, a plastic spatula, a sponge, or any other surface which can hold and deliver the liquid or solid material. In one embodiment, the applicator element 113 is in the form of a foam pad. In other embodiments, the applicator element 113 may be made of rubber, sponge, or any other flexible material.

In one embodiment, the applicator element 113 conforms to the geometry of the intended application area. For example, if the applicator is to be used to apply mascara, the applicator elements 113 may be slightly curved to conform to human eyelashes and may comprise a width comparable to the dimension of human eyelash array. Such a shape may allow for both curling and application of mascara to the eyelash in a single motion. Accordingly, depending on the ratio of the applicator width to the length of the eyelash array, one or more compressions of the applicator 110, e.g., pressing, squeezing, squeezing and pulling, may be used to cover the entire eyelash with product. In one embodiment, a gradient effect may be created by applying varying thicknesses of the product to different portions of the eyelash.

In one embodiment, the applicator element 113 may comprise any number of ridges. Such ridges may be used to straighten and separate eyelashes as a user slides the applicator 110 away from the root of the eyelashes. Depending on the product and application area, the applicator element 113 may comprise a rigid, flexible, smooth, flat, ridged, sponge, bristled, or curved surface. In one embodiment, different surfaces or treatments are provided on the applicator element 113 of each applicator arm 111. For example, the applicator element 113 on a first applicator arm 111 may comprise ridges, while the surface of the applicator element on a second applicator arm may be flat. As another example, the applicator elements 113 of two applicator arms 111 may be made interchangeable such that they may be selected by a user depending on the desired use. Beneficially, when the applicator has an applicator element associated with each lever, composition may be applied to the bottom and top of the eyelash simultaneously, providing a fuller look, and avoiding the unsightly clumping that often occurs when multiple strokes of the known bristle brush mascara applicators are used.

Typically, each arm 111 of the applicator 110 will have an applicator element 113 disposed on its inner surface. However, in certain embodiments, only a single arm 111 will have an applicator element disposed on its inner surface. The applicator element is affixed to the applicator arm 111 by a fastening means, such as but not limited to, an adhesive, Velcro®, snaps, buttons, or the like. Accordingly, in certain embodiments, a worn applicator element may be removed and replaced by a user. Alternatively, the applicator element 113 may be molded on to the surface of the applicator arm 111 during manufacturing of the component.

Figure 2:
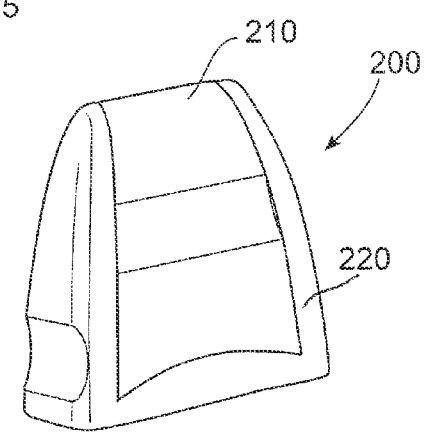
FIG. 2 illustrates an exemplary package for dispensing a material according to the invention, wherein an applicator 210 is shown in a nested or closed configuration.

Referring to FIG. 2, an exemplary package 200 is illustrated in a nested or closed configuration. The package comprises an applicator 210 seated within the cut-out portion of the container such that the applicator is in contact with the apertures of the container. When the applicator 210 is pressed completely onto the container 220, the arms of the applicator exert an inward force on the container, causing a seal between the applicator and the container. In other words, the distance between the two arms 211 of the applicator 210 is typically less than the distance between the first and second sides of the container 220, when the applicator is disengaged from the container. Accordingly, the package 200 does not require a separate cap, because, once the applicator 210 is seated within the cut-out portion of the container 220 (i.e., clamped onto the container), any product contained within the container is prevented from exiting through the pores. In one embodiment, the container 220 may also contain a physical ridge or channel into which the applicator 210 is inserted. The channel may contain snap-fit-ridges or a flexible material to further aide in sealing the applicator to the package.

Once the applicator 210 is seated on the container, material held within the container may be transferred to the applicator 210 via capillary action or by manual squeezing of container by a user. Thus, the applicator 210 may serve the dual purposes of sealing the package and transferring the material.

Figure 3:
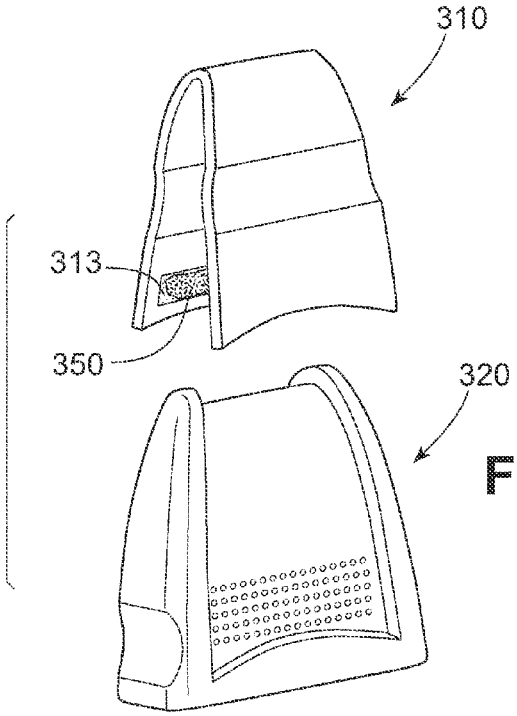
FIG. 3 illustrates an exemplary package for dispensing a material according to one embodiment, wherein an applicator 310 is removed from a container 320.

Referring to FIG. 3, the applicator 310 is shown removed from the container 320 with a charge of product 350 deposited on the applicator element 313. The applicator 310 is now available for transfer of the product 350, as shown, for example, in FIG. 5, discussed below.

Figure 4:
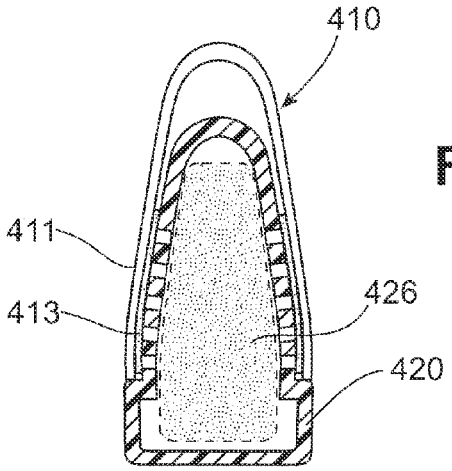
FIG. 4 is a cross-sectional view of an exemplary package 400 according to the invention.

Referring to FIG. 4, a cross-sectional view of an exemplary package of the invention is illustrated. As shown, an applicator 410 comprises two arms 411 having applicator elements 413 disposed thereon, and is seated on a container 420. The container 420 comprises a chamber in the interior thereof for holding a charge of a composition, such as a flowable composition. As shown, a structure 426, such as a non-woven material or a sponge, is impregnated with the composition. In this way, the composition may be prevented from leaking out of the apertures (not shown) when the applicator 410 is removed from the container 420.

Although not shown, the applicator 410 may comprise prongs or projections that extend from one arm 411 towards the other. The projections may be complementary to the apertures of a container 420, and may be adapted to fit within the apertures. In this way, when the applicator 410 is seated on the container, the projections may come into contact with material contained in the container 420, and may act to seal the container. Moreover, the container 420 may comprise a wiper or scraping element within its interior, which comprises one or more projections (e.g., edges, teeth, or the like) that engage with the projections of the applicator 410 when they extend into the interior of a container. When the applicator 410 is removed from the container 420, such as by pulling or the like, the projections may passes through the wiper, and any excess product contained thereon is freed and maintained inside the container. The dimension and geometry of the scraper element may vary depending on several factors, such as but not limited to, the thixotropy, pseudoelasticity, or other viscosity of the product and/or the shape and size of application element and/or the apertures.

Referring to FIG. 5, a process diagram for the application of a material using an exemplary applicator 510 is illustrated. Once the applicator elements 513 of the applicator 510 are impregnated with material, such as when a user squeezes a container in which the applicator is nested, the applicator may be removed and used to apply the material to a desired structure or surface. In one embodiment, the applicator 510 is removed from the container, and a wiper acts to remove excess product from the applicator elements 513.

In the case of mascara 550, a charged applicator 510 may be used to apply the mascara to a user's eyelashes. As shown, the user may align the applicator elements 513 with the entire or partial width of the eyelash span. By applying an inward force on the applicator arms (i.e., pinching, squeezing or clamping the applicator arms), the applicator elements 513 may transfer the mascara 550 to the eyelashes. For example, the user may squeeze the applicator 510 onto the eyelashes such that the applicator element 513 is placed into contact with the roots of the eyelashes. The user may then pull the applicator 510 along the eyelashes, towards the tips thereof, forcing the eyelashes to interact with applicator elements 513. This simplified action provides efficient yet comprehensive coverage and allows the user to apply an even and consistent coat of the mascara on the eyelashes. Moreover, this action allows for full contact between the applicator elements and both sides (top and bottom) of an entire row of eyelashes, simultaneously.

In one particular embodiment, the applicator 510 comprises a mechanical stop 515 for providing a minimal gap when its arms are pressed inward towards each other. The size of the gap may be selected to correspond to a typical thickness of human eyelashes. Accordingly, the presence of a gap may help to prevent the eyelashes from being pulled off as the user applies the product onto the eyelashes. In any event, the user may adjust the force on the eyelashes by removing some of the inward pressure placed on the applicator arms.

Figure 6:
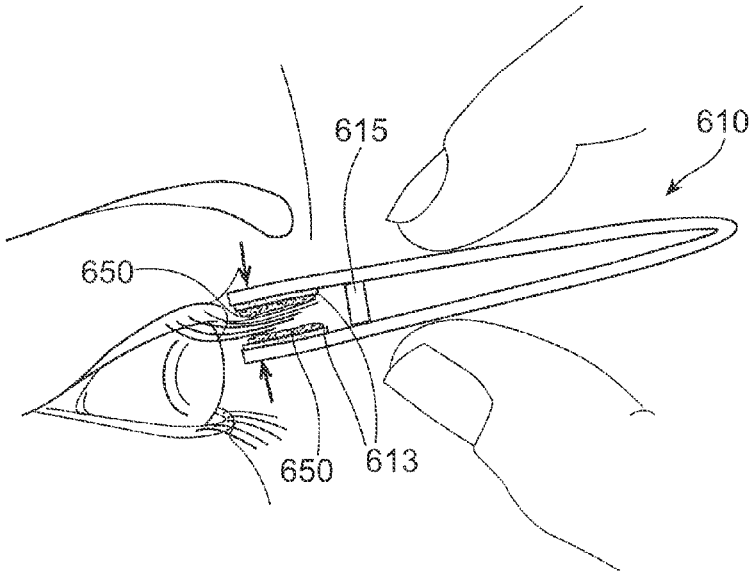
FIG. 6 is a process diagram for the application of a material, according to an exemplary embodiment.

Referring to FIG. 6, an exemplary applicator 610 is shown in a closed position, wherein the arms of the applicator are pressed inwards towards each other. As shown, the applicator elements 613 of the arms may be placed into contact with the eyelashes of a user. The mechanical stop 615 provides a minimal gap between the applicator arms when they are pressed inward towards each other.

The invention having been described by the forgoing description of the preferred embodiment, it will be understood that the skilled artisan may make modifications and variations of these embodiments without departing from the spirit or scope of the invention as set forth in the following claims.

All patent and non-patent literature discussed above is hereby incorporated by reference in its entirety for all purposes.

What is claimed is:

1. A package comprising:

(i) a container having an interior and an exterior, the interior comprising a chamber for holding a charge of a composition, the container further having two generally opposed faces, at least one of which comprises at least one passage to provide fluid communication between the interior of the chamber and the exterior of the container;

(ii) an applicator in the form of two elongated, planar levers adjoined on a fulcrum at one end thereof, the applicator being configured to be seated on said container such that at least one of said levers is positioned on the exterior of said container to cover exposed portions of said at least one passage and prevent escape of said composition from said container when said applicator is seated on said container; said applicator comprising an applicator element on a container-facing side of at least one of said levers for holding a charge of said composition; and wherein said applicator is capable of transferring said composition to a substrate by squeezing the applicator such that terminal ends of said levers contact said substrate, thereby transferring said composition onto said substrate.

2. A package according to claim 1, wherein the at least one passage comprises a plurality of apertures.

3. A package according to claim 2, wherein said container contains a liquid composition and said composition is transferred to said applicator via a capillary action.

4. A package according to claim 2, wherein the applicator contains prongs or projections adapted to seal the apertures in the container.

5. A package according to claim 2, wherein the apertures are provided on each of the generally opposed faces.

6. A package according to claim 2, further comprising a liquid composition disposed inside said container.

7. A package according to claim 6, wherein said liquid composition is pseudoplastic or thixotropic.

8. A package according to claim 7, wherein the applicator is adapted to transfer composition onto keratinous portions of a user.

9. A package according to claim 7, wherein said liquid composition is a mascara for application to an eyelash array.

10. A package according to claim 9, wherein the applicator comprises an applicator element on the container-facing side of each of said levers, said applicator elements comprising textured surfaces shaped to conform to the curve of eyelashes.

11. A package according to claim 6, wherein the apertures are provided on each of the generally opposed faces.

12. A package according to claim 2, wherein said container is made of a flexible material and wherein at least one applicator element has a textured surface.

13. A package according to claim 12, wherein at least one of said applicator elements is removable and/or replaceable by a user.

14. A package according to claim 12, wherein said container contains a liquid composition and said composition is transferred to said applicator by squeezing the container.

15. A package according to claim 12, wherein at least one of said textured surfaces comprises a rigid, flexible, smooth, flat, ridged, bristled, or curved surface.

16. A package according to claim 15, wherein at least one of said textured surfaces is shaped to conform to the curve of an eyelash array.

17. A package according to claim 15, wherein the applicator comprises an applicator element on the container-facing side of each of said levers, said applicator elements comprising different textured surfaces from one another.

18. A package according to claim 1, wherein said applicator has one or more depressed areas on one or both levers for facilitating a user's grip.

19. A package according to claim 1, wherein said applicator has one or more raised areas on one or both levers for facilitating a user's grip.

20. A package according to claim 1, wherein said container contains a liquid composition and said composition is transferred to said applicator by squeezing.

21. A package according to claim 1, wherein the chamber contains a substrate containing said composition.

22. A package according to claim 21, where in the substrate is a non-woven material or a sponge.

23. A package according to claim 1, wherein the container-facing side of at least one of the levers has a mechanical stop to restrict the movement of the levers when in use.

* * * * *